United States Patent [19]

Roberts

[11] Patent Number: 4,688,285

[45] Date of Patent: Aug. 25, 1987

[54] VENTILATED MEDICAL CUSHION OR PAD

[76] Inventor: Mildred E. Roberts, 3228 Capri St., Kingsport, Tenn. 37660

[21] Appl. No.: 910,079

[22] Filed: Sep. 22, 1986

[51] Int. Cl.[4] ..... A47C 27/00; A47C 27/14

[52] U.S. Cl. ..... 5/468; 5/481

[58] Field of Search ..... 5/468, 435, 434, 436, 5/481; 128/149; 297/453

[56] References Cited

U.S. PATENT DOCUMENTS

| | | | |
|---|---|---|---|
| D. 271,834 | 12/1983 | Huntsinger | 5/435 |
| 3,124,812 | 3/1964 | Milton et al. | 5/435 |
| 3,209,380 | 10/1965 | Watsky | 5/468 |
| 3,381,999 | 5/1968 | Steere | 5/468 |
| 4,070,719 | 1/1978 | Morgan | 5/481 |
| 4,233,700 | 11/1980 | Spann | 5/468 |

FOREIGN PATENT DOCUMENTS

| | | | |
|---|---|---|---|
| 1035073 | 7/1966 | United Kingdom | 5/468 |
| 1310373 | 3/1973 | United Kingdom | 5/481 |

*Primary Examiner*—Alexander Grosz

[57] ABSTRACT

A medical cushion for minimizing pressure areas on portions of the human anatomy and enhancing air circulation therearound, the cushion having an elastomeric body with a substantially overall rectangular cross-sectional configuration and having top, bottom and side surfaces, an aperture extending completely through the cushion from top to bottom, a plurality of slots in each of the top and bottom surfaces extending through said side surface and into the aperture, the slots and aperture being of sufficient size and number as to provide substantial air flow under, through and over the cushion in a continuous uninterrupted circulating manner.

5 Claims, 4 Drawing Figures

VENTILATED MEDICAL CUSHION OR PAD

The present invention relates to cushions or pads for preventing bed sores and the like and for relieving localized pressures on a bed patient or other such person who is relatively immobile or inactive and who may be in a variety of positions, such as sitting, or lying in bed. In particular, it relates to a pad of such design that is suitable for persons of various sizes, shapes and weights and is provided with novel air circulating means.

The pad is not only useful to bed-ridden patients who have developed decubitus ulcers but useful as a preventative for those who are likely to develop such ulcers. Such ulcers develop where there is little flesh under the skin and where the circulation is affected by prolonged pressure on the region as in the prone position.

The preferred material of the pad is an open celled flexible urethane foam of such density, pore size and rigidity that in use it does not bottom out, i.e., compress beyond its limits of resiliency. Typically useful foam materials have RMA (Rubber Manufacturers of America) values, i.e., the force required to compress a specimen 25% of its thickness under the conditions set forth in ASTM D1564-59T, of from about 36 to about 41 lbs/50 $in^2$ and densities of from about 1.45 to about 1.55 lbs/$ft^3$. Other similar materials varying in rigidity, softness, pliability and the like may of course be employed such as the foamed polyvinyls, depending on the particular tissue conditions and other physiological aspects of the patient and the intended use of the pad.

The open celled structure permits breathing of the foam which minimizes the tendency to perspire. Several grades of elastomeric foams, such as polyurethane foam, are available to provide the desired physical properties, and in addition, washability and the open cell structure.

The invention in its broad embodiment comprises a medical cushion for minimizing pressure areas on portions of the human anatomy and enhancing air circulation therearound, comprising an elastomeric body having a substantially overall rectangular cross-sectional configuration and having a top surface, a bottom surface, and side surface means (in this regard, where the overall shape of the cushion is circular as shown in FIG. 1, then geometrically the cushion has only one continuous side surface), aperture means extending completely through the cushion from top to bottom providing aperture surface means, slot means in each of the top and bottom surfaces extending through said side surface means and said aperture surface means, said slot means being in sufficient size and number to provide substantial air flow under, through and over the cushion in a continuous, uninterrupted circulating manner.

In certain preferred embodiments of the invention:

(1) the volumetric ratio of the total volume of said aperture means to the total overall cushion volume (volume of foamed elastomer+volume of aperture+volume of slots) is from about 0.006 to about 0.4 most preferably from about 0.01 to about 0.15, and the volumetric ratio of the total volume of said slot means to the total overall cushion volume is from about 0.05 to about 0.5, most preferably from about 0.08 to about 0.35;

(2) the cushion is substantially disc shaped, the aperture means comprises a single aperture substantially centrally located in the cushion, and wherein three to six slots are located in each of said top and bottom surfaces of said cushion;

(3) the said aperture means is tapered inwardly from said top surface to said bottom surface of said cushion; and (4) multiple aperture means are provided and at least some of which are directly interconnected by said slot means.

The preferred form of the pad is shown in the accompanying drawings, in which.

Figure 1:
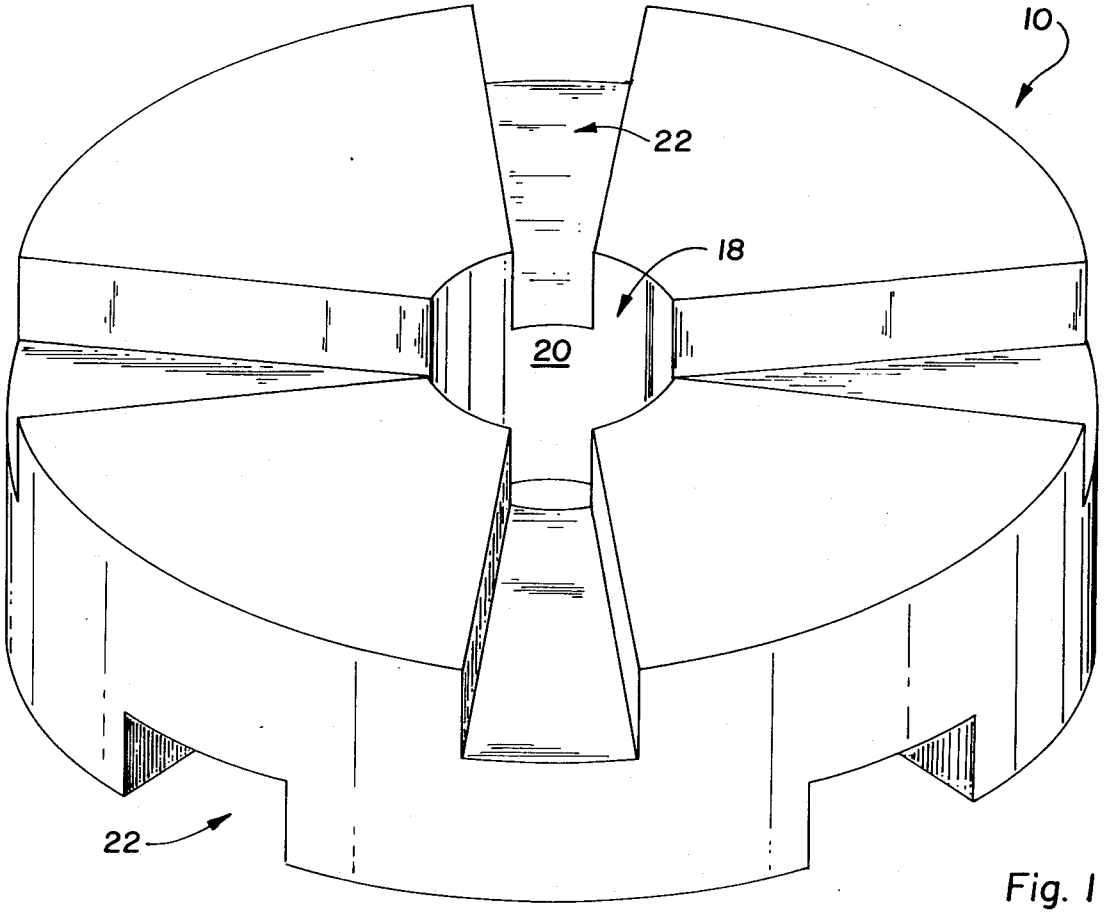
FIG. 1 is an isometric view of the cushion.

Referring the drawings, the cushion or pad comprises a body generally designated 10 of any suitable natural or synthetic material such as the foamed polyurethane or vinyl mentioned above, having a top surface 12, bottom surface 14, and side surface 16. A substantially centrally located aperture generally designated 18 is formed completely through the cushion providing aperture wall means 20. Preferably this aperture is tapered from top to bottom as shown more clearly in FIGS. 2 and 3. The slots generally designated 22 may be of any reasonable number and in any shape such as V, U or ⊔ cross-section, the latter being preferred. The slots may be straight, serpentine or tapered as shown which is preferred, and may be of any volume, preferably within the limits specified by the relative volumetric ratios given above and as long as the volume of each slot is not inordinately greater than that of the others such that either inadequate body support or overcompression of the surrounding surface portion of the cushion will occur resulting in inadequate or restricted circulation. Variations of the slots may be employed such as shown in FIG. 4 as having apertures therein directed straight through the cushion or directed angularly to interconnect slots in the top with slots in the bottom of the cushion.

Figure 4:
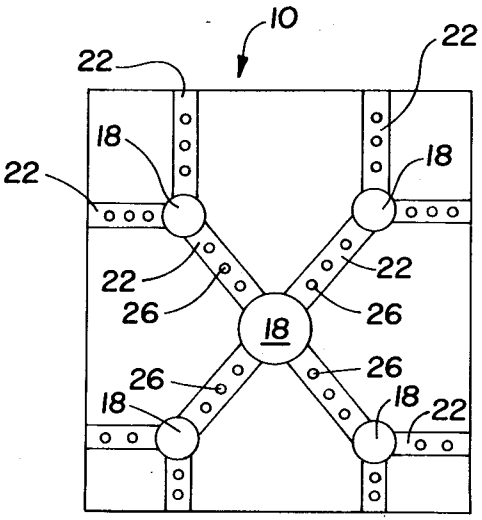
FIG. 4 is a variation of the cushion structure.

In said FIG. 4, the present invention is shown in an embodiment which has utility for larger cushions, and even to the size of a full mattress. In this embodiment the same theory of air circulation and body pressure relief obtain and the number of apertures 18, and slots 22 may be varied according to the size of the cushion.

Figure 2:
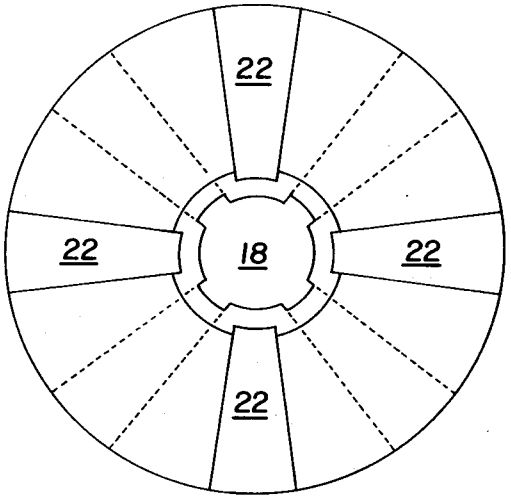
FIG. 2 is a top plan view thereof.
Figure 3:
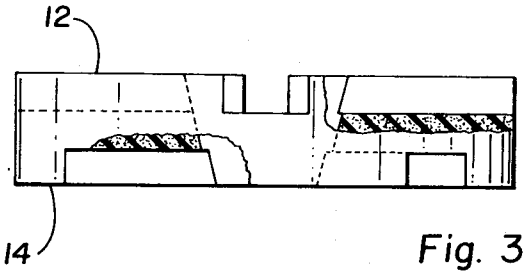
FIG. 3 is a side plan view of FIG. 2.

A typical highly effective set of dimensions for the cushion as determined under actual hospital use conditions are given in FIGS. 1 and 2.

The invention has been described in detail with particular reference to preferred embodiments thereof, but it will be understood that variations and modifications will be effected within the spirit and scope of the invention.

I claim:

1. A medical cushion for minimizing pressure areas on portions of the human anatomy and enhancing air circulation therearound, comprising an elastomeric body having a substantially overall rectangular cross-sectional configuration and having a top surface, a bottom surface and side surface means, aperture means extending completely through the cushion from top to bottom providing aperture surface means, a plurality of slot means in each of said top and bottom surfaces spaced angularly around said aperture means and extending through said side surface means and said aperture surface means, the top slot means being angularly offset from the bottom slot means, said slot means and aperture means being in sufficient size and number to provide substantial air flow under, through and over the cushion in a continuous uninterrupted circulating manner.

2. The cushion of claim 1 wherein the volumetric ratio of rhe total volume of said aperture means to the total overall cushion volume is from about 0.01 to about 0.15, and the volumetric ratio of the total volume of said slot means to the total overall cushion volume is from about 0.08 to about 0.35.

3. The cushion of claim 1 wherein the cushion is substantially disc shaped, the aperture means comprises a single aperture substantially centrally located in the cushion, and wherein three to six slots are located in each of said top and bottom surfaces of said cushion.

4. The cushion of claim 3 wherein the said aperture means is tapered inwardly from said top surface to said bottom surface of said cushion.

5. The cushion of claim 1 wherein multiple aperture means are provided and at least some of which are directly interconnected by said slot means.

* * * * *